US005573616A

United States Patent [19]

De Roeck

[11] Patent Number: 5,573,616

[45] Date of Patent: Nov. 12, 1996

[54] DEVICE AND METHOD FOR APPLYING ADHESIVE TAPE

[75] Inventor: Jozef De Roeck, St. Katelijne-Waver, Belgium

[73] Assignee: Agfa-Gevaert N. V., Mortsel, Belgium

[21] Appl. No.: 554,393

[22] Filed: Nov. 6, 1995

Related U.S. Application Data

[63] Continuation of Ser. No. 175,583, Dec. 30, 1993, abandoned.

[30] Foreign Application Priority Data

Jan. 8, 1993 [EP] European Pat. Off. ..... 93200044

[51] Int. Cl.[6] ..... B32B 31/00

[52] U.S. Cl. ..... 156/185; 156/187; 156/192; 156/446; 156/450

[58] Field of Search ..... 156/446, 448, 156/449, 450, 184, 187, 188, 190, 191, 192, 193, 195; 242/532.3

[56] References Cited

U.S. PATENT DOCUMENTS 3,901,757 8/1975 Eglinton ..... 156/446
3,943,030 3/1976 Olsen et al. ..... 156/446
4,371,410 2/1983 Stevens ..... 156/184 X
5,059,268 10/1991 Satoh et al. ..... 156/184 X

*Primary Examiner*—James Engel
*Attorney, Agent, or Firm*—William J. Daniel

[57] ABSTRACT

A double-sided differentially adhesive adhesive tape is applied to the winding core of a web processing machine, e.g. for producing light-sensitive photographic film, by a dispensing unit carried on a linearly movable support. In the unit, first and second tape applicator rollers are mounted for rotation on the support for engagement upon movement of the support to operative position with the core periphery at peripherally spaced apart points thereon, Tape extends from a supply roll to the first and then to the second roller for application of a winding thereof to the core upon rotation of the latter. The second roller is mounted on the support for limited independent movement after application of the tape winding to a position separated from the core and from the tape, such movement being in a direction generally tangential of the core periphery to avoid lifting the tape from the core. A third roller is then brought from an inoperative position into contact with the tape downstream of the second roller and the first roller is swung away from the core to lift a stretch of tape upstream of the third roller clear of the core and into contact with the separated second roller. A knife severs the lifted stretch of tape between the third and second rollers, the severed end remained adhered to the second roller for repetition of the cycle.

12 Claims, 6 Drawing Sheets

DEVICE AND METHOD FOR APPLYING ADHESIVE TAPE

This application is a continuation of application Ser. No. 175,583 filed Dec. 30, 1993, now abandoned.

BACKGROUND TO THE INVENTION

1. Field of the Invention

The present invention relates to a device for applying adhesive tape to the winding core of a web processing machine in general, and photographic web processing apparatus in particular.

2. Description of the Prior Art

Photographic sheet materials are often manufactured in the form of a web which is wound onto a winding core. The winding core is usually positioned at the end of the coating or processing machine. As one core becomes full, it is necessary to replace it and insert an empty core onto which further processed web may be wound. Processing machines are operated at high speed for reasons of economy and it is desirable not to have to stop or slow down the processing while winding cores are changed. Such processing machines therefore may include devices for cutting the processed web, moving a full core out of position and moving an empty core into position automatically and at high speed. The cut end of the web has to be reliably adhered to the empty winding core and in the past this has been achieved by the application of adhesive to the winding core before it is moved into position. Such a process is described for example, in U.S. Pat. No. 4,422,586 (Tetro/The Black Clawson Company), where a strip of adhesive is applied along the length of a winding core for this purpose. Since the photographic sheet material is cut while the machine continues to run, by running of a cutting blade across the web of sheet material, an angled cut is produced. The fresh end of the web is therefore angled in a predetermined manner and it is important to ensure that the point of this angle is reliably adhered to the empty winding core. Thus, it is appropriate to apply a circumferential line of adhesive to the winding core at an appropriate position along its length. The strip of adhesive may be in the form of a length of double-sided adhesive tape, applied to the winding core. The double-sided tape is applied by an operator using a hand-held tape dispenser comprising first and second applicator rollers and a support for a supply of adhesive tape, the support being so positioned to allow a run of adhesive tape from the supply to the first applicator roller and thence to the second applicator roller, with an adhesive side facing outwardly.

In applying the tape to the core, certain conditions have to be satisfied. The leading edge of the adhesive tape has to be applied to the winding core by hand. The winding core must rotate by at least one revolution to obtain a complete encirclement of the winding core by the tape. The tape must be positioned at exactly the correct position along the length of the core. All these conditions are difficult to ensure under low-light conditions or in darkness.

OBJECT OF THE INVENTION

It is therefore an object of the present invention to provide a device for applying adhesive tape to the winding core in a fast and reliable manner.

STATEMENT OF THE INVENTION

According to a first aspect of the invention there is provided a device for applying differential adhesion double-sided adhesive tape to the winding core of a photographic web processing machine, the device comprising: first and second applicator rollers; a support for a supply of adhesive tape, the support being so positioned to allow a run of double-sided adhesive tape from the supply to the first applicator roller and thence to the second applicator roller; and means for moving each applicator roller into and out of engagement with the winding core; characterised by means for allowing the second applicator roller to move away from the first applicator roller when the first and second applicator rollers are moved into engagement with the winding core.

According to a second aspect of the invention there is provided a method for applying differential adhesion double-sided adhesive tape to the winding core of a photographic web processing machine, the method comprising the use of a device comprising: first and second applicator rollers; a support for a supply of double-sided adhesive tape, the support being so positioned to allow a run of double-sided adhesive tape from the supply to the first applicator roller and thence to the second applicator roller; means for moving each applicator roller into and out of engagement with the winding core; and means for moving the second applicator roller relative to the first applicator roller; the method comprising the sequential steps of:

(i) moving the first and second applicator rollers into engagement with the winding core;

(ii) moving the second applicator roller away from the first applicator roller while maintaining engagement with the winding core, thereby to apply the free end of the double-sided adhesive tape thereto;

(iii) moving the second applicator roller out of engagement with the winding core, while maintaining engagement between the first applicator roller and the winding core; and (iv) rotating the winding core to cause a length of double-sided adhesive tape to be applied thereto.

In use, the double-sided adhesive tape is threaded from the supply to the first applicator roller and thence to the second applicator roller, the free end of the tape lying against the second applicator roller. The movement of the second applicator roller away from the first applicator roller enables the free end of the double-sided adhesive tape to be reliably applied to the winding core.

The inner face of the double-sided adhesive tape tends to adhere to the applicator rollers. Indeed, in the start position, the free end of the tape will be adhered to the second applicator roller. Supplies of double-sided adhesive tape generally comprise a non-adhesive interleaving tape which needs to be removed before use. The device according to the invention may include a take-up spool for this interleaving tape.

The double-sided adhesive tape is necessarily of the type which has faces of differential adhesion, the less adhesive face being usually applied to the winding core. This means that when the photographic sheet material is ultimately removed from the winding core, the double-sided adhesive tape remains adhered to the end of the photographic sheet material by being lifted away from the core. The core is therefore in a clean condition, suitable for re-use.

We have found that the relative movement of the applicator rollers can be achieved by mounting one of the applicator rollers, preferably the second applicator roller, on a pivoted arm. As the rollers are moved into engagement with the winding core, this arm will pivot and allow the movement of the second applicator roller away from the first applicator roller as required. Ideally, the second applicator roller is biased towards the first applicator roller and this can be achieved by the provision of a spring acting on the pivoted arm.

However, we have found that a more reliable operation of the device is achieved if the movement of the pivoted arm in the direction opposite to the bias direction of the spring is restricted. This can be achieved, for example, by the provision of a pawl and catch mechanism associated with the pivoted arm.

It is desirable that the device enables the double-sided adhesive tape to be cut in a predictable manner after application thereof to the winding core. According to a preferred feature of the present invention, a third applicator roller is provided, beyond the second applicator roller and most preferably relatively close thereto. Thus, the third applicator roller is so spaced as to allow the run of double-sided adhesive tape from the supply to the first and second applicator rollers and thence to the third applicator roller. With this arrangement the method of use may now include the further sequential steps of:

(v) moving the first applicator roller away from the winding core to expose a length of tape extending from the first to the second applicator roller, before reaching one revolution of the winding core;

(vi) ceasing the rotation of the winding core after more than one revolution thereof;

(vii) moving the third applicator roller into engagement with the winding core;

(viii) cutting the length of the tape extending between the second and third applicator rollers;

(ix) further rotating the winding core to cause the trailing cut end of the double-sided adhesive tape to be applied thereto; and (x) moving the third applicator roller out of engagement with the winding core.

Naturally, the length of tape extending between the second and third applicator rollers may be cut by hand, but we prefer that the device includes a knife blade and means for moving the knife blade into and out of a cutting position between the second and third applicator rollers. The tape is held in place, in a tensioned condition, between a guide roller and the second applicator roller. Friction means, such as a spring, acting on the second applicator roller, restrict free rotation thereof and a pawl and ratchet acting on the guide roller prevent the reverse rotation of the guide roller, thereby preventing retraction of the tape after the cutting thereof.

The device according to the invention preferably includes a timing device, for example linked mechanically or electronically to the control system of the processing machine, in order to ensure the performance of the method of use in the desired sequence.

Movement of various elements of the device may be achieved in a number of ways, but we have found the use of pneumatic cylinders to be particularly suitable.

Ideally, the device comprises two parts. A first removable part of the device comprises a support plate carrying the double-sided adhesive tape supply support and the applicator rollers. A second part of the device, which normally remains in a fixed position relative to the processing machine, comprises a support plate carrying the drive means for the various movable elements of the device. In this way the replacement of the double-sided adhesive tape supply is facilitated. The first part of the device can be loaded in white light conditions with a supply of tape, the tape can be threaded accurately to the application rollers and then the first part can be placed in position, by engaging a releasable connection with the second part.

The support plate of the second part of the device may carry a fixed pin which engages the catch of the pawl and catch mechanism when the second part of the device is secured to the first part.

A tape applicator mechanism comprising two applicator rollers for applying a tape to an object, is disclosed in U.S. Pat. No. 3,676,266. This tape applicator comprises a square rotatable member onto the four sides of which lengths of tape are applied in succession by pulling tape from a supply roll and cutting the tape at corners between adjacent sides. Each time a next length of tape is brought with its centre in contact with a corner of a rectangular article and then the applicator rollers wipe the tape onto the faces of the article as they both become outwardly displaced by their rolling on the tape, supported by the article. This mechanism is unsuited for the application of tape around a roll because the mechanism operates with pre-cut, stationary tape lengths that have to be applied to a stationary object.

The present invention is particularly valuable for use with the web processing machine described in more detail in co-pending application numbers EP 93 20 00 43.3 and EP 93 20 00 42.5 respectively entitled "Web Cutting Device" and "Clamping Device".

BRIEF DESCRIPTION OF THE DRAWINGS

The invention will now be described in further detail with reference to the accompanying drawings in which.

DETAILED DESCRIPTION OF THE INVENTION

Figure 1:
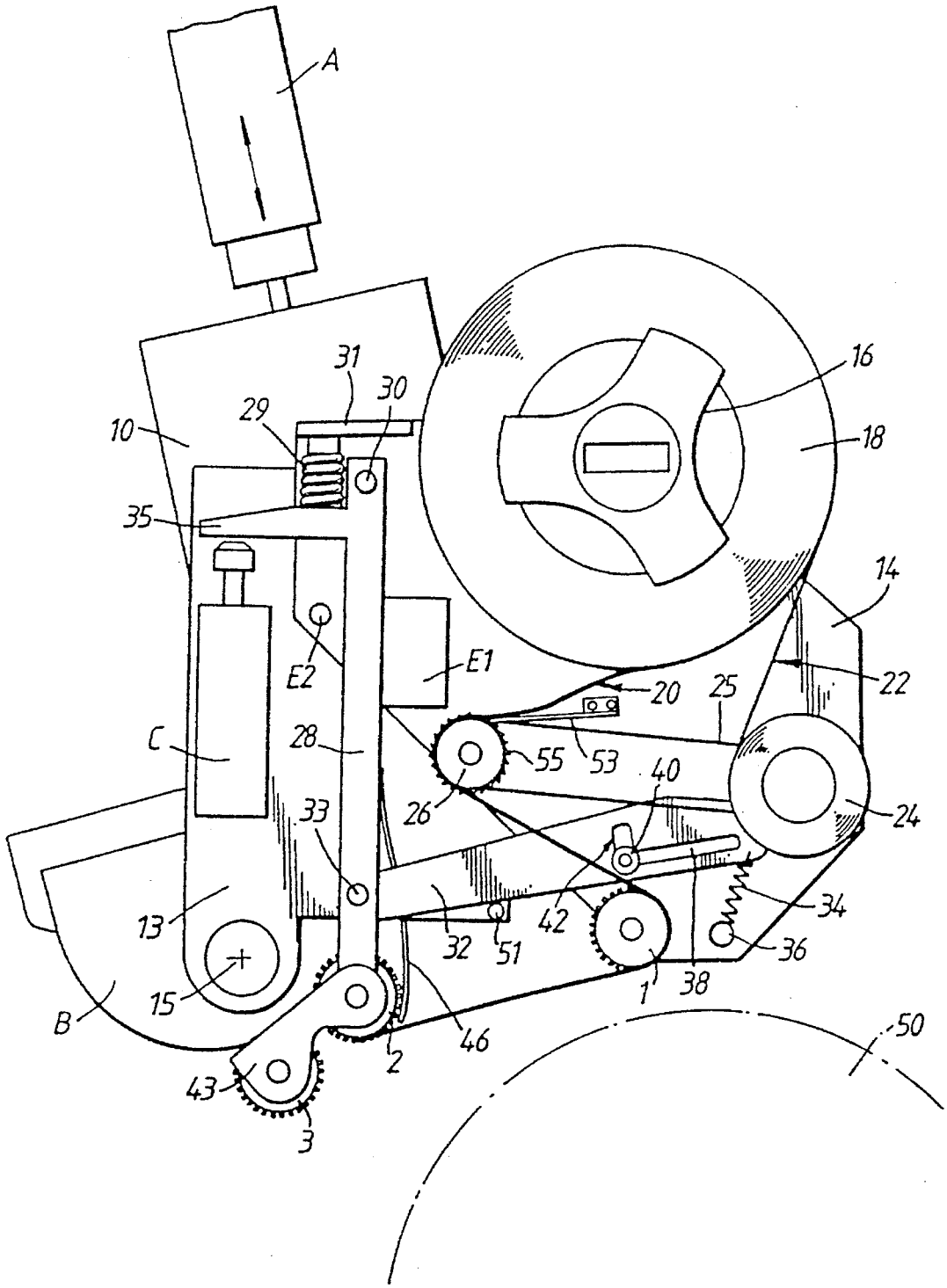
FIG. 1 shows a front elevation of the dispensing device in a position ready for use.

A first pneumatic cylinder A is mounted in a fixed position and operates on a primary support plate 10 to move the latter in a substantially vertical direction as shown in FIG. 1, that is, in a direction towards and away from the axis of rotation of the winding core 50, shown as dotted lines in FIG. 1. Mounted on the primary support plate 10 are two secondary support plates 13 and 14, the removable support plate 14 being removable from the non-removable support plate 13. The two support plates can be rotated about an axis 15 relative to the primary support plate by means of a second pneumatic rotating motor B, secured by means not shown to the primary support plate 10. It is the removable support plate 14 which carries the essential components of the dispensing device. Thus, a flanged spool clamp 16 is provided to support a supply 18 of differential adhesion double-sided adhesive tape. A suitable tape is 3M—SCOTCH brand tape No. Y 9415. This tape supply comprises a tape 20 of clear polyester material having adhesive coating on both faces and an intermediate non-adhesive interleaving tape 22. The interleaving tape 22 is taken to an interleaving tape take-up spool 24 which is mounted on the removable support plate 14 and driven from a guide roller 26 by a drive belt 25. The double-sided adhesive tape 20 passes over the guide roller 26, which is carried on the removable support plate 14 to a first applicator roller 1, which is also mounted on the removable support plate 14. The guide roller 26 is integral with a ratchet wheel 55 which is engaged by a leaf spring 53 mounted on the removable support plate 14, which engages the pawl disc 55 and acts as a pawl to prevent retraction of the tape. The arrangement is such that the outer face of the double-sided adhesive tape, as it passes over the first applicator roller 1, is the face which will in use be applied to the winding core 50. The tape is of the type with different adhesion on each side. That side with the highest adhesion lies against the applicator rollers, while that side with the least adhesion is the side which will be applied to the winding core 50.

Figure 1C:
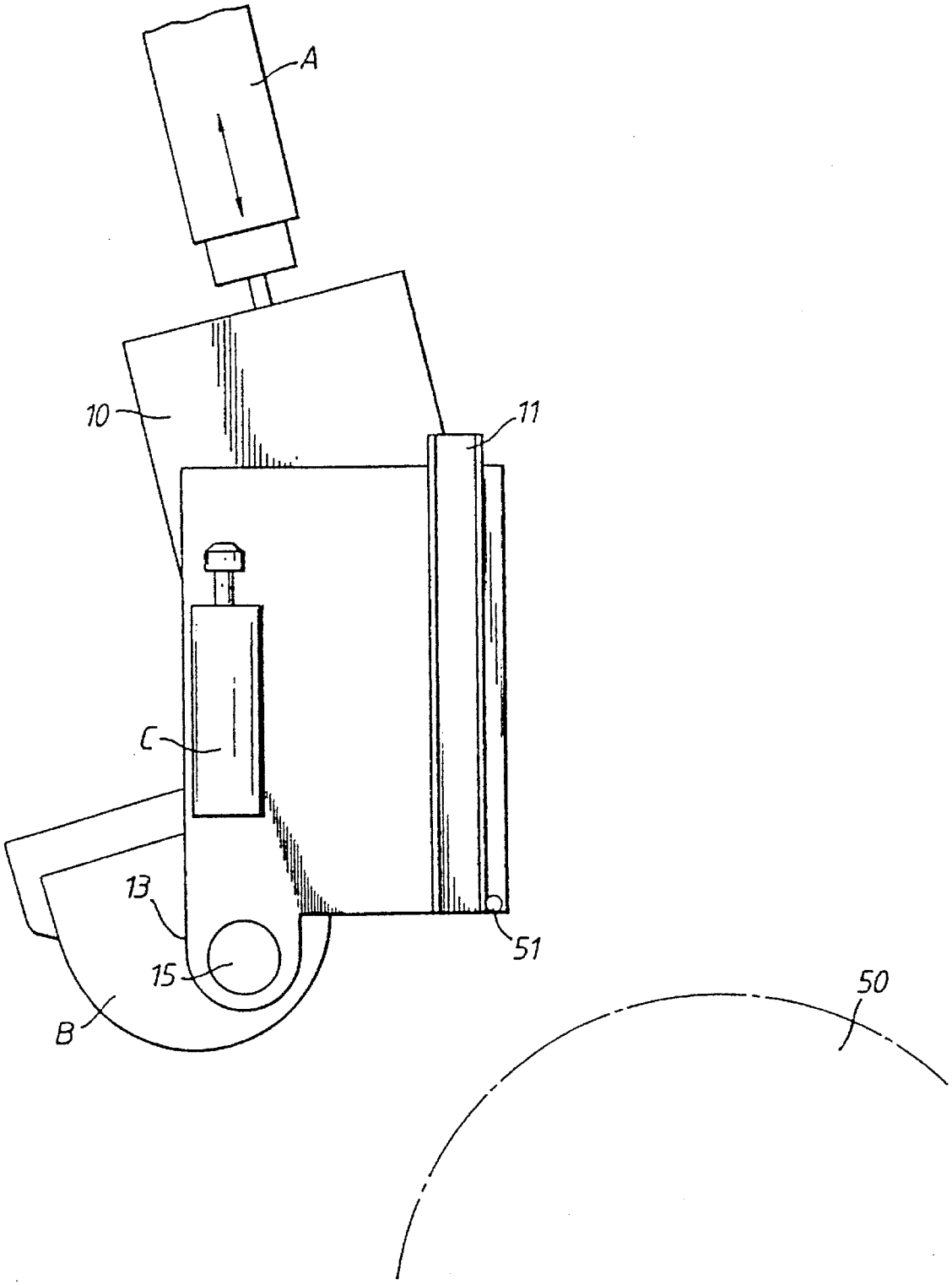
FIG. 1C shows the fixed part of the dispensing device of FIG. 1, in the disassembled position.
Figure 2:
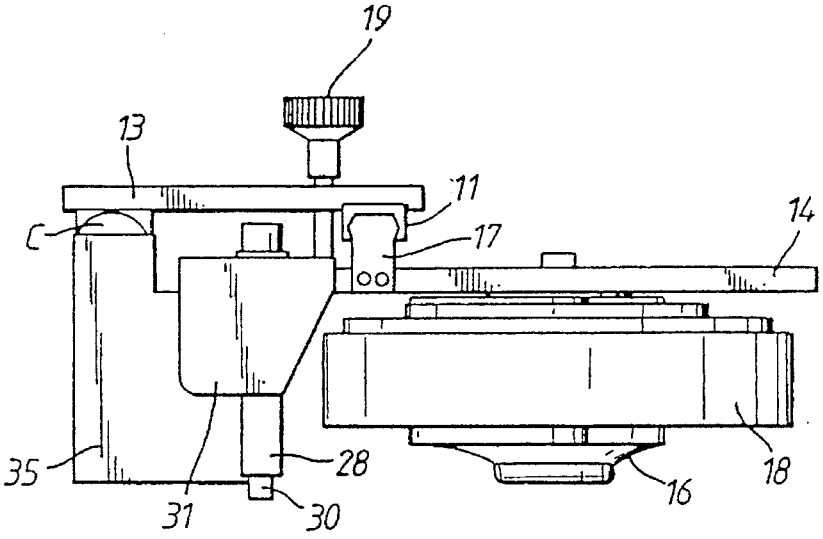
FIG. 2 is a part view from above of the dispensing device of FIG. 1.

The advantage of using two support plates 13 and 14 is that the supply of double-sided adhesive tape 18 may be placed in position and the tape threaded correctly over the tape path as shown, in the light. The removable support plate 14 of the device may then be affixed to the non-removable support plate 13 by a simple releasable connection as shown in more detail in FIGS. 1C and 2. Thus the non-removable support plate 13 carries a guide rail 11 which is engaged by a complementarily shaped slider 17 mounted on the removable support plate 14. A manually releasable locking screw 19 serves to hold the removable support plate 14 in position on the non-removable support plate 13. The removable support plate 14 can in be affixed to the non-removable support plate 13 in the dark or semi-dark conditions of the processing machine environment.

Second and third applicator rollers 2 and 3 respectively are carried at the lower end of a pivoted arm 28 which is pivoted at its upper end to the removable support plate 14, by way of a pivot pin 30. The pivoted arm 28 has a limited degree of freedom of movement, limited by stops E1 and E2 carried on the removable support plate 14. The pivoted arm 28 is urged towards the right-hand stop E1 by a spring 29 mounted between an upstanding edge 31 of the removable support plate 14 and a fixed side arm 35 of the pivoted arm 28, while a pneumatic cylinder C carried on the non-removable support plate 13 and acting against the fixed side arm 35 is capable of moving the pivoted arm in the opposite direction.

The peripheral surface of each of tape applicator rollers 1, 2 and 3 is selected such as to have a reduced adhesion with the tape surface. In the present example the rollers have a covering of silicone rubber on a steel core, and the peripheral surface of this covering is provided with a plurality of axially aligned grooves, thereby forming corresponding teeth as shown in cross-section by the crenelated shape of these rollers in FIGS. 1, 1A and 1B. It is clear that other surface structures such as wafers may be used for these rollers to limit the adhesion to the inside face of the tape.

Carried on the pivoted arm 28, towards the lower end thereof is a side arm 32, pivoted at 33 and spring-loaded by tension spring 34 which extends between the free end of the side arm 32 and a fixed point 36 on the removable support plate 14. Along the length of the side arm 32 is a locking slot 38 which is engaged by a pin 40 mounted on the removable support plate 14. The slot 38, while generally longitudinal, has a lateral extension 42, extending in a direction generally opposite to the bias direction of the spring 34 so as to retain the pin 40 in a position preventing longitudinal movement of side arm 32 and thus preventing pivoting of the pivoted arm 28, until the side arm 32 is raised against the bias of the spring 34 allowing the pin 40 to escape into the generally longitudinal portion of the slot 38. Thus, in the disassembled position, the spring 34 causes the side arm 32 to pivot, allowing the pin 40 to enter the lateral extension 42 of the slot 38, to prevent the pivoting of the arm 28. The raising of the side arm 32 occurs when the removable support plate 14 of the device is affixed to the non-removable support plate 13, by abutment of the arm 32 against a fixed pin 51 mounted on the non-removable support plate 13. It will be seen that when the pin is engaged in the lateral extension 42, the pivoted arm 28 is at the extreme right-hand limit of its pivotal movement about pin 30.

At the lower end of the pivoted arm 28 is carried the second applicator roller 2. Pivoted to the same axis of rotation as the applicator roller 2 is a relatively short arm 43 carrying at its free end a third applicator roller 3. The short arm 43 is spring-loaded by means not shown in FIG. 1, in a downwards direction. As will be seen in FIG. 1A, the short arm 43 carries a finger 45, from the free end of which a spring 48 extends to the end of an adjustable bolt 49, secured to the pivoted arm 28 by the aid of a nut 47. Bearing against the surface of the second applicator roller 2 is a friction plate 46 secured to the side edge of the pivoted arm 28, so as to restrain the free rotation of the second applicator roller 2.

Thus, the three applicator rollers 1, 2 and 3 are arranged with their axes of rotation parallel, but with the possibility of limited relative displacement by operation of the pneumatic devices A, B and C.

In particular, applicator roller 2 can be moved out of engagement with the core selectively of applicator roller 1 while roller 3 can be moved into engagement with the winding core, selectively of rollers 1 and 2 operation of the pneumatic devices A and B, and the second applicator roller 2 can be moved laterally away from the first applicator roller 1 by causing the pivoted arm 28 to be pivoted to the left as seen in FIG. 1 by operation of the pneumatic cylinder C.

The apparatus works as follows.

Figure 3:
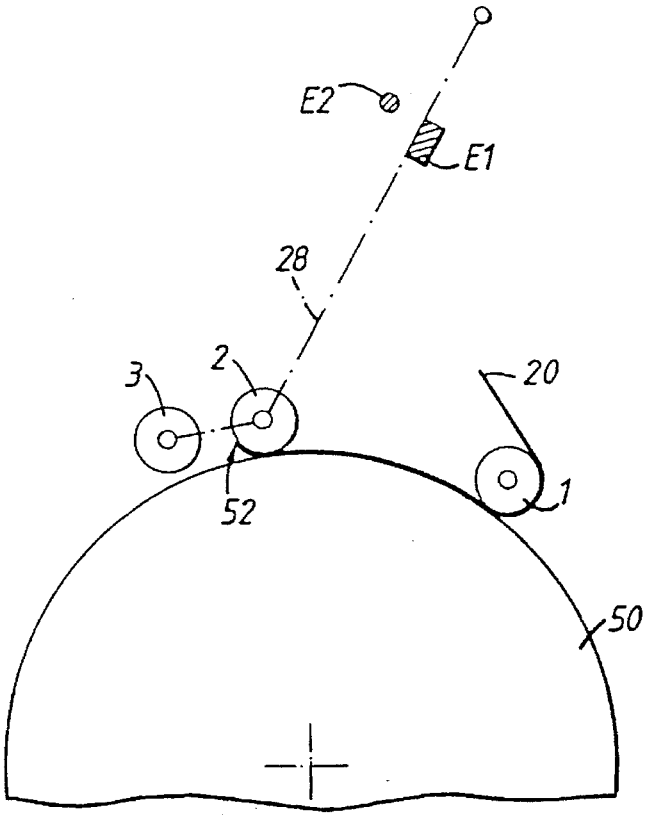
FIGS. 3 to 7 show in diagrammatic form various stages of the use of the dispensing device shown in FIG. 1.

As a first step, in order to supply the unit with the tape dispensing device, the pivoted side arm 32 is lifted by the pin 51 when mounting the removable support plate 14 in a downwards direction as seen in FIG. 1 onto the non-removable support plate 13 and securing the locking screw 19. This causes the pin 40 to leave the lateral extension 42 of the locking slot 38 enabling movement of the pin in the longitudinal portion slot 38. As shown in FIG. 3, the first and second applicator rollers 1 and 2 are moved into engagement with the winding core 50. The free end 52 of the double-sided adhesive tape 20, lies against the second applicator roller 2.

Figure 6:
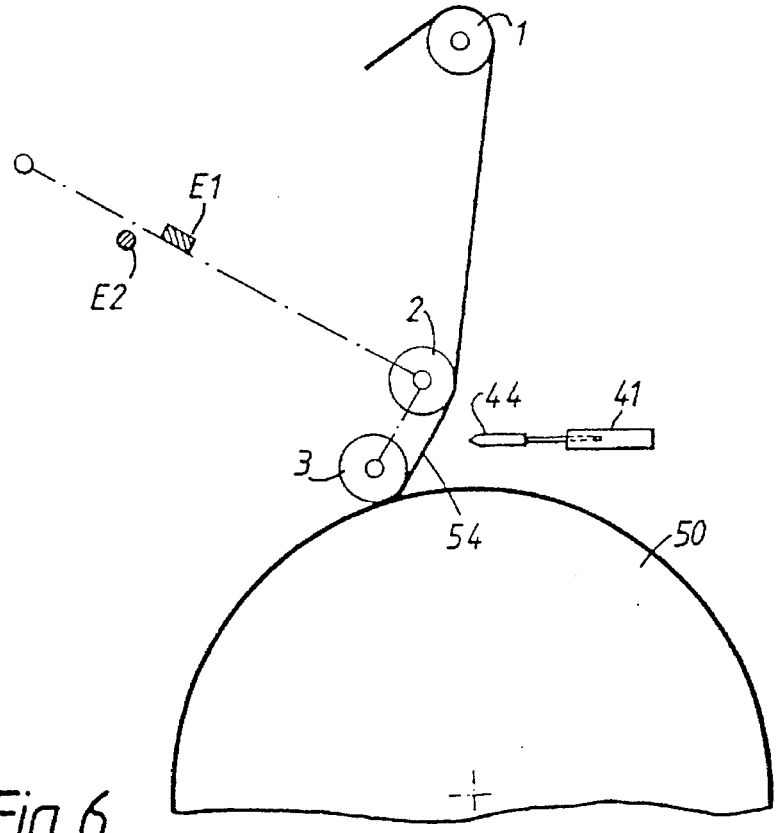
Figure 7:
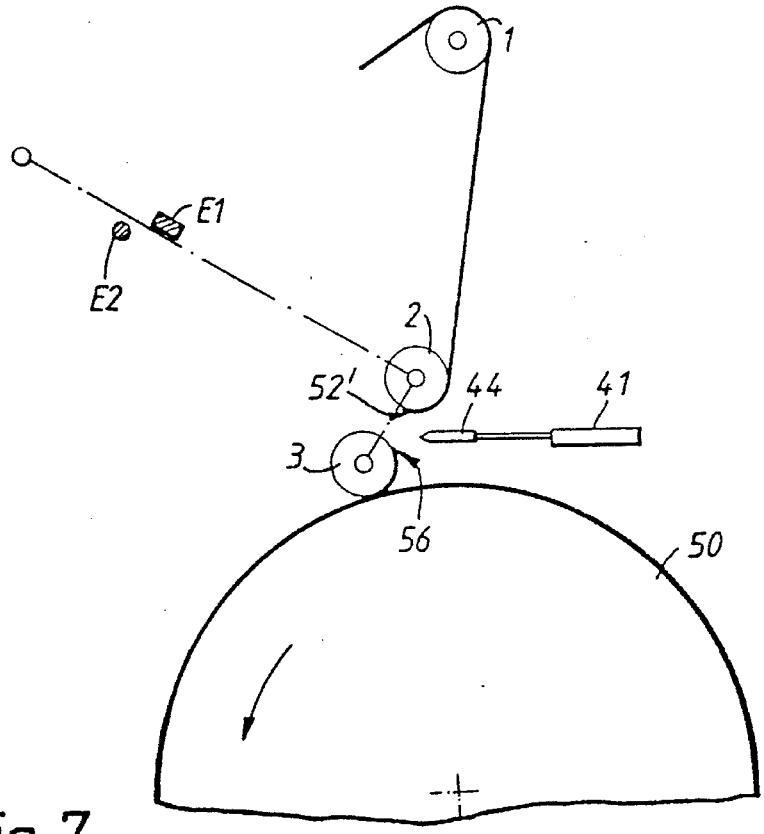

Although not shown in FIG. 1, there is attached to the primary support plate 10, at the lower end thereof, a knife-operating mechanism which comprises a knife blade 44 (see FIGS. 6 and 7) carried on an arm which is operated by a pneumatic cylinder 41, the arrangement being such that the knife may be extended into the tape cutting position shown in FIGS. 6 and 7 while at other times in the operating sequence it may be retracted out of the way to a rest position.

Figure 4:
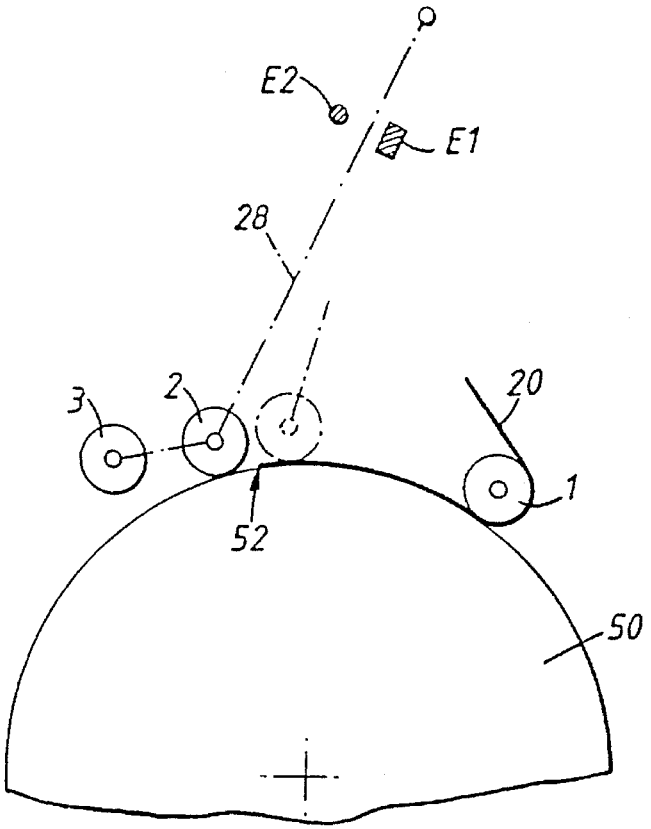

As shown in FIG. 4, as the cylinder A pushes the dispenser further in the direction of the core 50, pivotal movement of the pivoted arm 28 partially away from stop E1 to the left causes the second applicator roller 2 to move laterally away from the first applicator roller 1, while maintaining engagement with the winding core 50, thereby to apply the free end of the double-sided adhesive tape 20 thereto. At this point, further tape 20 begins to be fed from the spool 18.

Figure 5:
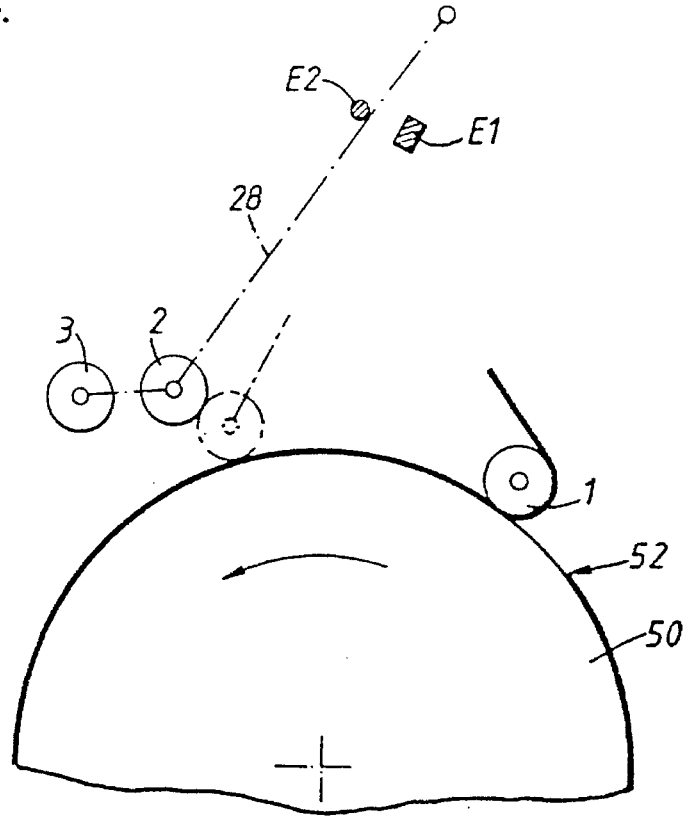

By operation of the pneumatic cylinder C, the pivoted arm 28 is swung fully to the left against the stop E2. This causes the second applicator roller 2 to move out of engagement with the winding core 50, as shown in FIG. 5, while maintaining engagement between the first applicator roller 1 and the winding core 50. Thereafter, the winding core 50 is rotated through a predetermined angle in the direction of the curved arrow in FIG. 5 to cause a length of double-sided adhesive tape 20 to be applied to the winding core. At the same time the pneumatic cylinder B is activated to rotate the plate 13 together with plate 14 carried thereon about 90° about the axis 15 thereby to prepare for the next phase. The applicator roller 1 is swung away from the core by this movement as is applicator roller 2 with the tape remaining adhered to roller 2. Where it is desired to apply tape round the whole circumference of the core, it is suitable to rotate the core by 1.2 rotations. Cylinder C is now retracted and the spring 29 causes the applicator roller 3 to engage with the winding core 50 (See FIG. 6), to hold the double-sided adhesive tape 20 against the winding core.

Figure 1A:
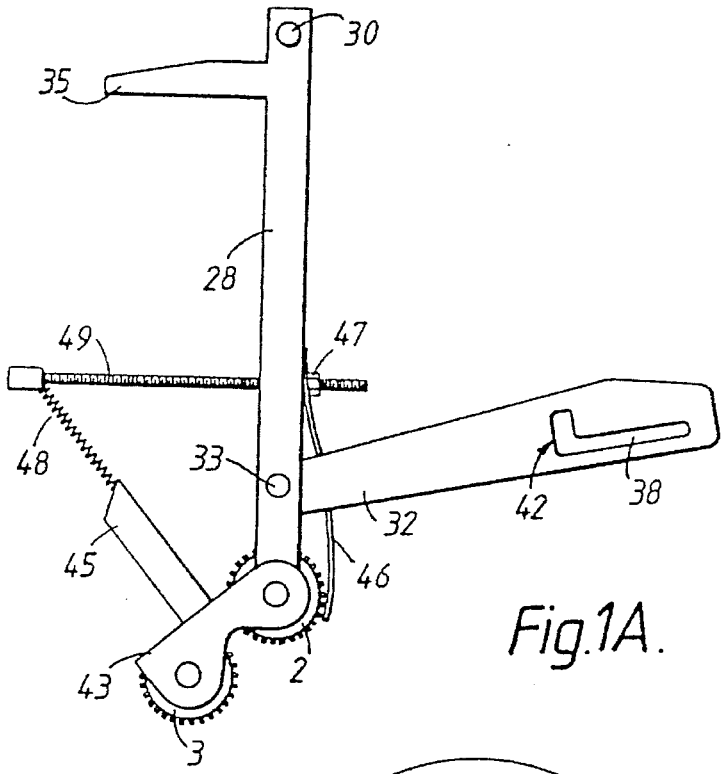
FIG. 1A shows a detail of part of FIG. 1.
Figure 1B:
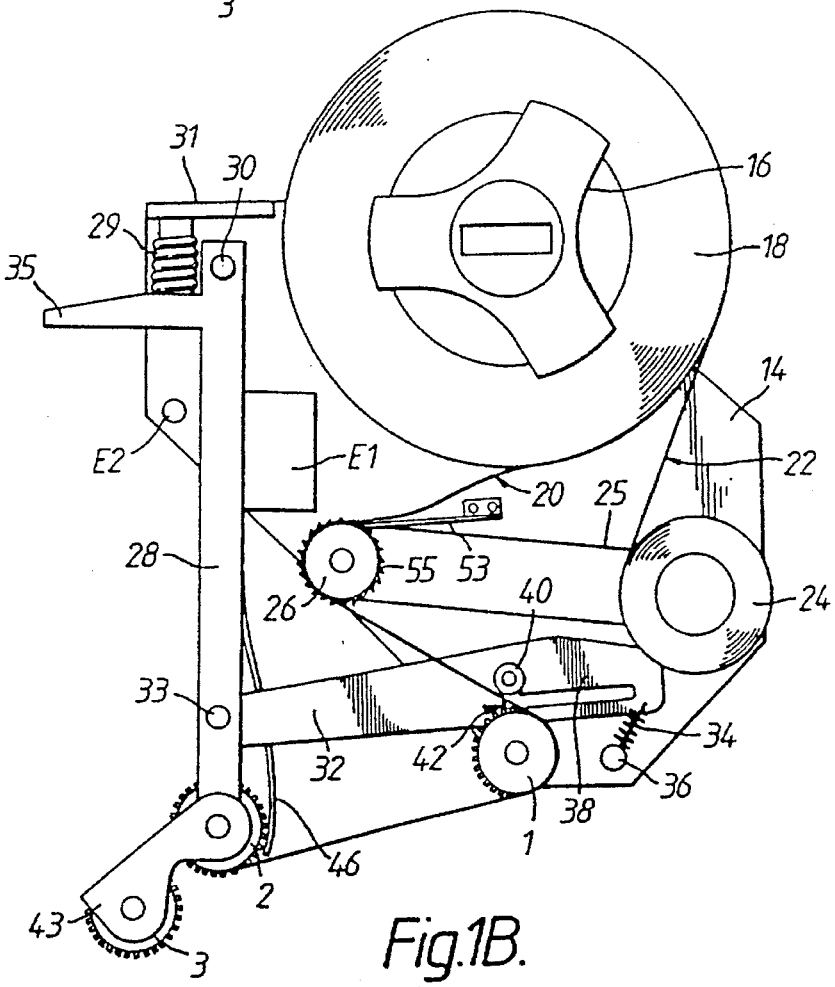
FIG. 1B shows a removable part of the dispensing device of FIG. 1, in the disassembled position.

The pressure applied by the third applicator roller 3 includes spring pressure from the tension spring 48 (see FIG. 1*a*). The movement of cylinder C also causes the pivoted arm 28 to pivot to the right under bias of the spring 29 against the stop El, to expose a length 54 of tape extending from the second applicator roller 2 to the third applicator roller 3. At this stage, the tape 20 still contacts the applicator roller 2 at a slight angle of wrap.

The knife-operating mechanism 41 is now activated to cause the knife blade 44 to move into the cutting position as shown in FIG. 7 to cut the length 54 of tape extending between the second applicator roller 2 and the third applicator roller 3.

As shown in FIG. 7, the winding core 50 is then rotated, over a short angle, to cause the trailing cut end 56 of the double-sided adhesive tape 20 to be applied thereto, pressed into place by the applicator roller 3, while leaving a freshly cut free end 52 which curls and becomes adhered to the second applicator roller 2.

Now that the pivoted arm 28 has returned to the right, against the stop E1, the pawl acts on the ratchet associated with guide roller 26 prevents any reverse rotations of this roller. This "ratchet and pawl" system prevents the tape from being drawn Lack into the dispenser, which by virtue of the elasticity of the tap may otherwise occur. The friction plate 46 acting on the second applicator roller 2 prevents this roller from rotating, thereby to retain a residual stress in the tape between applicator rollers 2 and 3.

Finally, the cylinder A retracts to raise the primary support plate 10 and thus the entire dispensing unit, moving the third applicator roller 3 out of engagement with the winding core 50, the cylinder B rotates the plates 13 and 14 back about the axis 15 and the knife 44 is returned to its rest position to be ready for a fresh winding core to be put in place.

The reliability of operation of the device according to the invention is high. However, in view of the vital importance of the adherence of the fresh end of a web to an empty winding core, the correct application of a tape to the winding core yet was manually examined for each new web. We have found that the reliability of the device is a disadvantage in this respect since the attention of the operator may wander after thousands of perfect tape applications. If then an operation of the tape dispenser does not produce a correct tape-winding on the core, this may pass unnoticed having for consequence an interruption of the production process. It may therefore be desirable to provide detection means signalling the correct application of a tape. Common infrared or capacitive sensors can be used to this end.

I claim:

1. A dispensing device for applying a double-sided adhesive tape around the periphery of a winding core of a web processing machine which is rotatable in a given direction, which device comprises a support means adapted to be moved bodily towards and away from an operative position adjacent the periphery of the winding core, support positioning means for moving said support means bodily towards and away from said operative position, means on said support means for holding a supply roll of double-sided adhesive tape for unwinding of the tape therefrom, first and second applicator rollers rotatively carried on said support means for contact when said support means is in said operative position with the core periphery at circumferentially spaced apart points thereon, said tape when said rollers are moved to said operative position extending from said supply roll to said first roller and then to said second roller and pressed thereby against said core periphery, with said second roller situated downstream of said first roller in the direction of core rotation, said second applicator roller being mounted on said support means for limited independent bodily movement relative to the first applicator roller in a direction generally tangential to said core periphery at the point of contact thereon of said second roller, and actuator means operative to move said second roller away from said first roller in said generally tangential direction a sufficient distance to separate said second applicator roller from said core periphery and from said tape while the tape is held against the core periphery by said first roller, whereby the adhesive adherence of the tape to the second roller exerts on the tape during the independent movement of the second roller a substantially tensile force promoting continued adhesion of the tape to the core periphery during separation of the tape from said second applicator roller.

2. The tape dispensing device of claim 1 which further comprises opposed stop means for limiting the independent movement in said generally tangential direction of said second applicator roller between minimum and maximum separation positions, said minimum separation being less than the circumferential spacing between said first and second rollers when said support means is in said operative position, and yieldable biasing means operative to normally bias said second roller to said minimum separation position, whereby upon movement of said support means with the applicator rollers carried thereon to said operative position, said second roller is displaced against said biasing means by contact with the core periphery with the tape pressed therebetween in said generally tangential direction away from said first roller and away from said minimum separation position partially towards said maximum separation position, said displacement being sufficient to separate said second roller from said tape while the tape remains adhered to said core periphery.

3. The tape dispensing device of claim 2 wherein said second roller is carried at an end of an elongated arm extending at a substantial angle to a tangent through the point of contact of said second roller with said core periphery and pivoted on a pivot axis at its opposite end on said support means and said biasing means acts on said arm.

4. The tape dispensing device of claim 3 wherein said support means includes a linearly bodily movable main supporting plate and a secondary supporting plate detachable from said main plate, said detachable plate carrying said tape supply roll and said first and second applicator rollers, whereby reloading of said tape supply roll and threading of said tape to and between said applicator rollers can be carried out when said plate is detached, said detachable plate having said elongated arm pivotally mounted thereon, and which further comprises latching means operable to temporarily latch said elongated arm against pivotal movement around said pivot axis when said secondary plate is detached, said latching means being disengaged when said secondary plate is attached to said main supporting plate.

5. The tape dispensing device of claim 1 wherein said support means includes a linearly bodily movable main supporting plate and a secondary supporting plate which carries said tape supply roll and said applicator rollers, said secondary supporting plate being detachable from said main supporting plate while carrying said supply roll and said rollers thereon as a unit, whereby reloading of said tape supply roll and threading of said tape to and between said applicator rollers can be carried out when said secondary plate is detached.

6. A dispensing device for applying a double-sided adhesive tape around the periphery of a winding core of a web processing machine which is rotatable in a given direction, which device comprises a support means adapted to be moved bodily towards and away from an operative position adjacent the periphery of the winding core, support positioning means for moving said support means bodily towards and away from said operative position, means on said support means for holding a supply roll of double-sided adhesive tape for unwinding of the tape therefrom, first and second applicator rollers rotatively carried on said support means for contact when said support means is in said operative position with the core periphery at circumferentially spaced apart points thereon, said tape when said rollers are moved to said operative position extending from said supply roll to said first roller and then to said second roller and pressed thereby against said core periphery, with said second roller situated downstream of said first roller in the direction of core rotation, said second applicator roller being mounted on said support means for limited independent bodily movement relative to the first applicator roller in a direction generally tangential to said core periphery at the point of contact thereon of said second roller, and actuator means operative after said winding of tape has been applied to said winding core to move said second roller away from said first roller in said generally tangential direction a sufficient distance to separate said second applicator roller from said core periphery and from said tape while the tape is held against the core periphery by said first roller, whereby the adhesive adherence of the tape to the second roller exerts on the tape during the independent movement of the second roller a substantially tensile force promoting continued adhesion of the tape to the core periphery during separation of the tape from said second applicator roller, said support means including a linearly bodily movable main supporting plate and said means on said support for holding the tape supply roll comprises a secondary supporting plate detachable from said main plate, said detachable plate carrying said tape supply roll and said applicator rollers, whereby reloading of said tape supply roll and threading of said tape to and between said applicator rollers can be carried out when said secondary plate is detached, said supporting means further comprising a carrier plate pivotally mounted on said linearly bodily movable main plate and detachably supporting thereon said secondary supporting plate for pivotation therewith, a third application roller rotatably mounted on said carrier plate at a point on a side of said second applicator roller opposite to said first applicator roller and normally separated from the periphery of said winding core, and actuator means for pivoting said carrier plate to a position removing said first and second applicator rollers from contact with the periphery of said winding core and bringing said third roller into contact with said core periphery and the tape applied thereto, and tape cutting means operable to sever the tape intermediate said third roller and said second roller.

7. The tape dispenser device of claim 6 including means for resisting retraction of the tape after it has been severed by said cutting means.

8. The tape dispenser device of claim 7 wherein said resistance means comprises roller braking means acting on said second applicator roller to resistance rotation thereof in a retraction direction of said tape.

9. A method of applying a double-sided adhesive tape around the periphery of a winding core of a web processing unit that is adapted for rotation in a given direction, which comprises the steps in sequence of:

a. Feeding double-sided adhesive tape from a tape supply roll to first and second applicator rollers arranged in rolling contact with the peripheral surface of said winding core with the tape therebetween, said first and second rollers being disposed at peripherally spaced apart points normally separated a predetermined distance with said second roller downstream of said first roller in the direction of rotation of said core, b. Moving said second applicator roller away from said first applicator roller and away from said core periphery while said tape is held on said core periphery by said first applicator roller upstream of said second roller, said movement of said second roller being in a direction substantially tangential to the locus of contact of said second roller with said core periphery and for a distance sufficient to separate said second roller from said tape whereby separation of said second applicator roller from contact with said core periphery exerts on the tape adherent thereon mainly tensile forces substantially free of forces directed radially of said core, and c. Thereafter rotating said winding core in said given through a predetermined degree of rotation to apply a winding of tape around the core periphery under rolling contact of said first roller.

10. The method of claim 9 wherein said double-sided tape has a differential adhesion on its two opposite faces and the lower adhesive face is directed toward said core periphery.

11. A method of applying a double-sided adhesive tape around the periphery of a winding core of a web processing unit that is adapted for rotation in a given direction, which comprises the steps in sequence of:

a. Feeding double-sided adhesive tape from a tape supply roll to first and second applicator rollers arranged in rolling contact with the peripheral surface of said winding core with the tape therebetween, said first and second rollers being disposed at peripherally spaced apart points normally separated a predetermined distance with said second roller downstream of said first roller in the direction of rotation of said core, b. Moving said second applicator roller away from said first applicator roller and away from said core periphery while said tape is held on said core periphery by said first applicator roller upstream of said second roller, said movement of said second roller being in a direction substantially tangential to the locus of contact of said second roller with said core periphery and for a distance sufficient to separate said second roller from said tape, whereby separation of said second applicator roller from contact with said core periphery exerts on the tape adherent thereon mainly tensile forces substantially free of forces directed radially of said core, and c. Thereafter rotating said winding core in said given through a predetermined degree of rotation to apply a winding of tape around the core periphery under rolling contact of said first roller;

and wherein after said winding core has been rotated to apply a winding of tape around said core periphery, displacing a third applicator roller from an inoperative position spaced from said core periphery on a downstream side of said second applicator roller to an operative position making rolling contact with said core periphery and engaging the tape thereon, displacing said first applicator roller away from said core periphery to separate from the core periphery a stretch of tape extending between the third and first rollers and bring said stretch of tape into contact with said second roller in its separated position over a sufficient are of said second roller that said tape adheres to said second roller, and then severing said tape intermediate said third and second rollers to generate a free leading end on the tape while the tape immediately upstream of said free leading end remains adhered to said second roller.

12. The method of claim 11 wherein after said tape has been severed, restoring said first and second applicator rollers into contact with said core periphery at said peripherally spaced points thereon and said third roller to its inoperative position to repeat said sequence of steps upon a new winding core.

* * * * *